United States Patent [19]

Keirn

[11] 3,955,288

[45] *May 11, 1976

[54] CONTINUOUS FLOW GRAIN DRYING APPARATUS

[76] Inventor: Robert E. Keirn, R.R. No. 2, South Whitley, Ind. 46787

[ * ] Notice: The portion of the term of this patent subsequent to Mar. 11, 1992, has been disclaimed.

[22] Filed: Feb. 18, 1975

[21] Appl. No.: 550,297

[52] U.S. Cl. ..... 34/174; 34/65; 34/171

[51] Int. Cl.[2] ..... F26B 19/00

[58] Field of Search ..... 34/64–66, 34/165–174

[56] References Cited

UNITED STATES PATENTS

| | | | |
|---|---|---|---|
| 3,313,040 | 4/1967 | Mathews | 34/174 |
| 3,526,969 | 9/1970 | Alms et al. | 34/174 |
| 3,869,809 | 3/1975 | Keirn | 34/174 |

*Primary Examiner*—John J. Camby
*Assistant Examiner*—James C. Yeung

[57] ABSTRACT

Continuous flow grain drying apparatus having an upper, foraminous drying enclosure into which grain to be dried is introduced and which communicates with a lower, foraminous cooling enclosure. A first enclosed, foraminous duct in the upper enclosure defines therewith a first pair of passages which divide the downward flow of grain into two separate parallel streams, a blower and burner combination communicating with the first duct causing outward flow of heated air simultaneously through the first passages. A second, enclosed, foraminous duct is provided in the lower enclosure defining therewith a second pair of passages and a divider connects the first and second ducts and extends through the open ends of the upper and lower enclosures thereby coupling respective ones of the first and second passages so that the two streams respectively continue separate, downward, parallel flow through the second passages. A blower communicates with the second duct causing an outward flow of cooling air simultaneously through the second passages. The two streams of grain are discharged, separately, from the bottom of the lower enclosure. The lower enclosure and second duct are formed so as to divide each of the second passages into upper and lower sections. The upper passage sections are respectively wider than the lower passage sections so that the grain in the upper passage sections is cooled more slowly than the grain in the lower passage sections thereby temper-cooling the grain.

6 Claims, 1 Drawing Figure

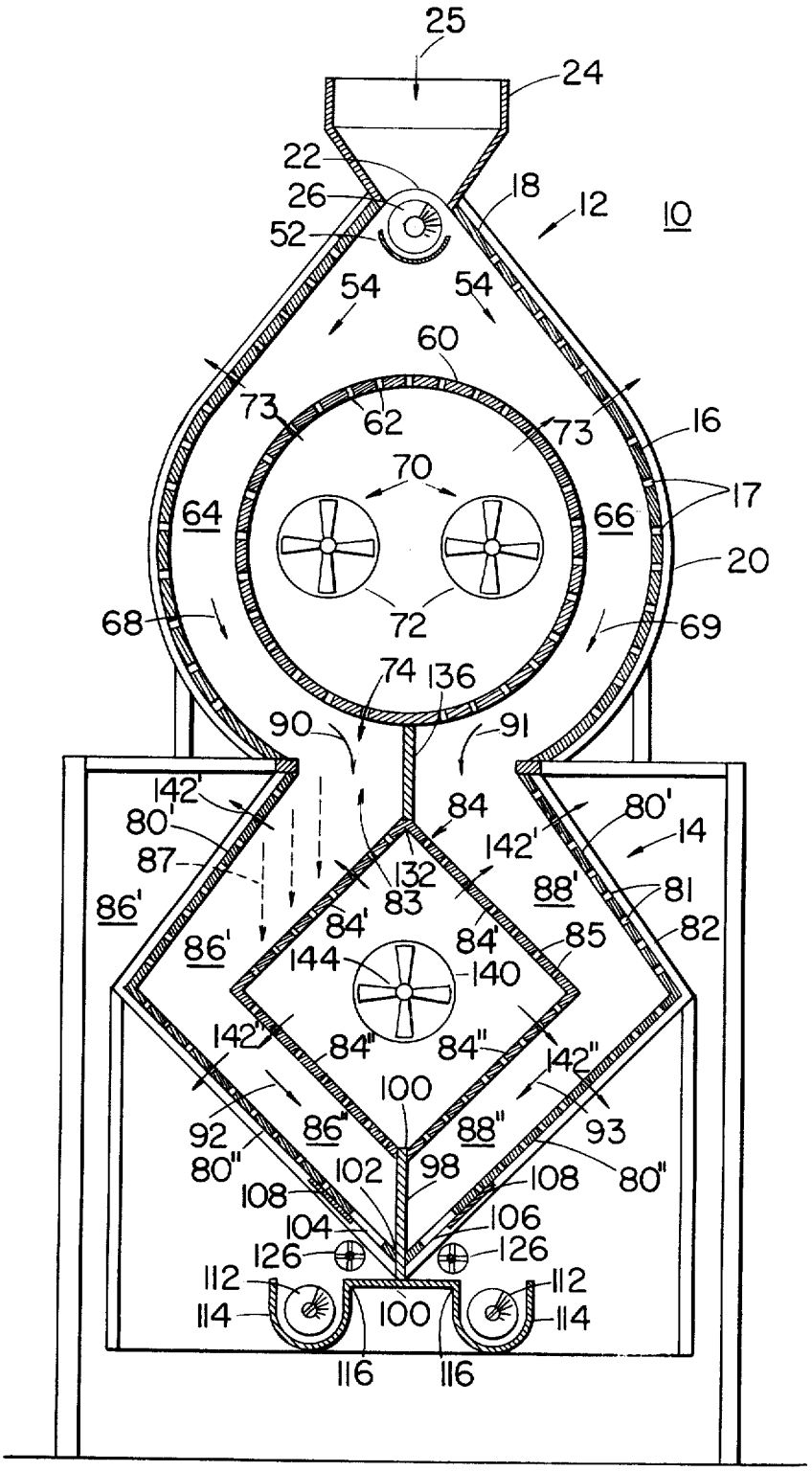
25
24
22
26
18
12
10
52
54
54
60
73
62
73
16
70
17
64
66
20
68
72
69
74
136
90
91
142'
84
80'
80'
14
87
142'
132
88'
81
86'
83
84'
84'
85
82
86'
144
140
142"
84"
84"
142"
100
92
86"
88"
93
80"
102
98
108
80"
108
104
106
126
126
112
112
114
100
114
116
116

CONTINUOUS FLOW GRAIN DRYING APPARATUS

BACKGROUND OF THE INVENTION

1. Field of the Invention

This invention relates generally to continuous flow grain drying apparatus.

2. Description of the Prior Art

In the storage of grain such as corn, it is a common practice to dry the grain to remove a portion of the moisture content thereof. Many types of batch-type and continuous flow grain drying apparatus have been proposed and used. Typically, such prior grain drying apparatus included one or more chambers arranged to permit a flow of grain to gravitate downwardly therethrough, the grain being first subjected to a flow of heated, dry air which removes moisture and thereafter is subjected to a flow of cool air so as to cool the grain.

In one type of prior grain drying apparatus, the grain is passed through the apparatus in a single, relatively large column thus requiring the use of a multiplicity of air inlet and outlet ducts in order to minimize the length of the air flow paths through the grain. Further, passing the grain through the drying apparatus in a single column results in some portion of the grain being subjected to more or less heating and cooling than other portions.

U.S. Pat. No. 3,526,969 to Erhard E. Alms and James E. Mitchell discloses batch-type grain drying apparatus having separate drying and cooling chambers. Batch-type grain drying apparatus of the type shown in the aforesaid Alms et al patent employing only a drying chamber has also been used.

British Pat. No. 326,871 discloses continuous flow grain drying apparatus employing counter-flow of drying air.

In certain installations, by reason of its increased capacity, greater heating and cooling efficiency, and reduced operating expense continuous flow grain drying apparatus is preferred to the batch-type apparatus. Since there are many existent installations of batch-type drying apparatus of the type shown in the aforesaid Alms et al patent, it is desirable to convert such batch-type apparatus to continuous flow apparatus.

My U.S. Pat. No. 3,869,809, granted Mar. 11, 1975 (allowed application Ser. No. 397,068, filed Sept. 13, 1973) discloses continuous flow grain drying apparatus employing the drying chamber portion of batch-type drying apparatus, such as that shown in the aforesaid Alms et al patent, but eliminating the holding bin and cooling chambers, if any, and adding thereto a new cooling chamber with flow dividing means in the drying and cooling chambers providing a pair of passages therethrough thus dividing the downward flow of grain into two separate, parallel streams.

SUMMARY OF THE INVENTION

While the continuous flow grain drying apparatus of my aforesaid patent operates satisfactorily in the drying of grain, I have found that by proportioning the upper sections of the cooling chamber passages to be wider than the lower sections, the grain flowing downwardly in the upper passage sections of the cooling chamber cools more slowly than the grain flowing downwardly in the lower passage sections which, in the particular case of corn, inhibits the formation of stress cracks. Subjecting the hot, wet corn in the upper sections of the cooling chamber passages to slower air flow by reason of the thicker corn mass provides less severe cooling so as to avoid stress cracks; as the corn cools in its transit to the lower sections of the cooling chamber passages, it can be subjected to faster, cooler air flow since the cooler corn is less susceptible to stress-cracking.

In its broader aspects, the improved continuous flow grain drying apparatus of the invention comprises an upper, foraminous drying enclosure having a top end and an open bottom end with means for introducing grain to be dried to the upper enclosure adjacent its top end for downward gravity flow therethrough. First, enclosed, foraminous duct means is provided in the upper enclosure for defining therewith a first pair of passages therein which divide the downward flow into two separate, parallel streams, and means are provided communicating with the first duct means for causing an outward flow of heated air simultaneously through the first passages. A lower, foraminous cooling enclosure is provided having an open top end connected to the bottom end of the upper enclosure and having a bottom end, and second enclosed, foraminous duct means is provided in the lower enclosure for defining therewith a second pair of passages therein. Divider means is provided connecting the first and second duct means and extending through the open ends of the enclosures for coupling respective ones of the first and second passages so that the two streams respectively continue separate, downward, parallel flow through the second passages. Means are provided communicating with the second duct means for causing an outward flow of cooling air simultaneously through the second passages, and means are also provided adjacent the bottom end of the lower enclosure for respectively, separately discharging the streams from the second passages whereby the two streams are maintained separate without co-mingling throughout their downward flow through the apparatus. The lower enclosure and second duct means are respectively formed to divide each of the second passages into upper and lower sections, the upper passage sections being respectively wider than the lower passage sections so that the grain in the upper passage sections is cooled more slowly than the grain in the lower passage sections thereby temper-cooling the grain.

It is accordingly an object of the invention to provide improved continuous flow grain drying apparatus.

Another object of the invention is to provide improved continuous flow grain drying apparatus which temper-cools the grain and inhibits the formation of stress cracks therein.

The above-mentioned and other features and objects of this invention and the manner of attaining them will become more apparent and the invention itself will be best understood by reference to the following description of an embodiment of the invention taken in conjunction with the accompanying drawing.

BRIEF DESCRIPTION OF THE DRAWINGS

The single FIGURE of the drawing is a cross-sectional view of the improved continuous flow grain drying apparatus of the invention.

DESCRIPTION OF THE PREFERRED EMBODIMENT

Referring now to the drawing, the same reference numerals are used to designate the same elements as in my aforesaid U.S. Pat. No. 3,869,809 which is incorporated herein by reference.

The improved continuous flow grain drying apparatus of the invention, generally indicated at 10, comprises an upper, drying enclosure, generally indicated at 12, and a lower, cooling enclosure, generally indicated at 14. Upper enclosure 12 includes a generally cylinderical side wall 16 fabricated from foraminous sheet material, such as perforated steel, having a multiplicity of openings 17 therein. The top portion of side wall 16 has a longitudinally extending protuberance portion 18, and the entire side wall 16 is reinforced with a plurality of peripherally extending, longitudinally spaced-apart ribs 20. End walls (not shown) join the opposite ends of side walls 16 and complete enclosure 12. Inlet opening 22 is formed in protuberance 18 adjacent one end wall and accumulator hopper or storage bin 24 communicates therewith, grain being introduced to upper enclosure 12 through hopper 24 and inlet opening 22, as shown by arrow 25.

Helical loading auger 26 extends longitudinally within protuberance portion 18 and is rotatably supported by bearings (not shown) in the end walls of enclosure 12. Auger 26 is driven by a suitable drive motor (not shown). Distribution trough 52 is mounted vertically beneath and closely adjacent auger 26. The direction of rotation of auger 26 is such that grain introduced thereto through inlet opening 22 is moved along trough 52 and is distributed into upper enclosure 12 throughout the length thereof, as shown by arrows 54.

A first cylinderical duct 60 is mounted coaxially within upper enclosure 12 extending between its end walls, duct 60 also being fabricated of foraminous sheet material and havng a multiplicity of openings 62 therein. Duct 60 defines two passages 64, 66 with side wall 16 of enclosure 12 thereby dividing the downward, gravitational flow of grain into two separate parallel streams, as shown by arrows 68, 69.

Conventional blower-heater units 70 are mounted on an end wall of enclosure 12 and communicate with the interior of duct 60 through openings 72 therein. Blower-heater units 70 thus force heated air into duct 60 and outwardly through openings 62 therein, across passages 64, 66, and outwardly through openings 17 in side wall 16 of enclosure 12, as shown by arrows 73, the flow of heated air simultaneously through passages 64, 66 thus heating and partially drying the parallel streams 68, 69 of downwardly flowing, wet grain therein.

The bottom end of side wall 16 of upper enclosure 12 has longitudinally extending opening 74 formed therein. Lower, cooling enclosure 14 has upper, outwardly and downwardly inclined side wall sections 80', and lower, downwardly and inwardly inclined side wall sections 80'' both fabricated of foraminous sheet material having a multiplicity of openings 81 thereon. The end walls (not shown) are common to the upper and lower enclosures 12, 14. Side wall sections 80', 80'' are supported by a plurality of peripherally extending, longitudinally spaced-apart ribs 82. Lower enclosure 14 has longitudinally extending inlet opening 83 formed therein communicating with discharge opening 74 of upper enclosure 12.

A second duct 84, which is substantially square in cross-section, is provided within lower enclosure 14 extending between the side walls thereof. Duct 84 has upper, downwardly and outwardly inclined side wall sections 84', and lower, downwardly and inwardly inclined side wall sections 84'', both formed of foraminous sheet material having a multiplicity of openings 85 therein. Upper side wall sections 80' of lower enclosure 14 and upper side wall sections 84' of duct 84 define upper passage sections 86', 88' therebetween, and lower side wall sections 80'' and 84'' define lower passage sections 86'', 88'' therebetween.

Vertically extending, imperforate divider plate 136 extends between top apex 132 of duct 84 and the bottom portion of duct 60, divider plate 136 extending vertically through openings 74, 83 and longitudinally between the end walls of upper and lower enclosures 12, 14. Divider plate 136 thus bisects openings 74, 83 so as directly to connect passages 64, 86 and 66, 88 so that the two, parallel streams of grain 68, 69 in passages 64, 66 of upper enclosure 12 are maintained separate and continue downward gravity flow as separate, parallel streams in passages 86, 88 of lower enclosure 14, as indicated by arrows 90, 91 and 92, 93.

Conventional blower assembly 144 is mounted on one end wall of enclosure 14 and communicates with the interior of duct 84 through opening 140 therein. Blower assembly 144 forces cool, ambient air into the interior of duct 84, outwardly through openings 85, across passages 86, 88, and outwardly through openings 81, as shown by arrows 142, the simultaneous flow of air through passages 86, 88 cooling the parallel streams of grain flowing downwardly therethrough.

Another vertically extending, imperforate divider plate 98 extends between lower apex 100 of duct 84 and lower apex 102 of lower side wall sections 80'' of lower enclosure 14, divider plate 98 extending longitudinally between the end walls of enclosures 12, 14. Discharge openings 104, 106 are formed in lower side wall sections 80'' of lower enclosure 14 adjacent bottom apex 102 respectively on opposite sides of divider plate 98 and respectively communicating with lower passage sections 86'', 88'', the separate, downwardly flowing, parallel streams of grain in passages 86, 88 of lower enclosure 14 being separately discharged through openings 104, 106. Flow control gates 108 are provided for respectively selectively adjusting the size of discharge openings 104, 106.

Flat plate member 110 extends longitudinally beneath discharge openings 104, 106 on either side of divider plate 98. Metering rolls 126 are positioned beneath discharge openings 104, 106, above plate 110, and on either side of divider plate 98 for respectively metering the grain discharged through openings 104, 106. A pair of discharge augers 112 are respectively located in troughs 114 which are respectively attached to the side edges 116 of plate 110; discharge augers 112 receive grain respectively metered by metering rolls 126 from discharge openings 104, 106. Discharge augers 112 are driven by a suitable drive motor (not shown). Metering rolls 126 may be driven by a suitable variable speed motor (also not shown).

Lower side wall sections 80'', 84'' of lower enclosure 14 and duct 84 are in spaced, parallel relationship so that lower passage sections 86'', 88'' are of substantially equal width throughout their lengths. However, in accordance with the present invention, upper side wall sections 80', 84' converge downwardly from their upper ends to their lower ends so that upper passage sections 86', 88' are respectively wider at their upper ends than at their lower ends where they join lower passage sections 86'', 88''.

In converting batch-type grain drying apparatus of the type shown in the aforesaid Alms et al patent to the continuous flow apparatus described above, the holding bin of the batch-type apparatus, if present, is eliminated, small hopper 24 is installed, and distributing auger 26 is installed. The lower cooling chamber, if present, is removed (and may be used as the drying chamber for another continuous flow dryer) and the drying chamber is elevated, as need be. Divider plate 136 is then installed followed by installation of lower enclosure 14 having duct 84 and divider plate 98 therein, together with metering rolls 126, unloading augers 112, and the associated drive and control apparatus (more fully shown and described in my aforesaid U.S. Pat. No. 3,869,809).

In the operation of the continuous flow grain drying apparatus 10, grain is continuously fed into the upper drying enclosure 12 through hopper 24 and inlet opening 22, the grain being longitudinally moved and discharged into upper enclosure 12 by loading auger 26 which uniformly distributes the grain over the longitudinal length of upper enclosure 12. The grain then passes downwardly by gravity and is divided into two separate and substantially equal streams in passages 64, 66, as shown by arrows 68, 69. Heated, drying air is forced by blower-heater assembly 70 simultaneously outwardly through passages 64, 66, as indicated by arrows 74, thereby heating and drying the two separate, downwardly flowing streams of grain. It will be observed that the grain travels a substantial distance as it follows the parallel paths 64, 66 and that the path the heated, drying air must traverse in passing through the grain is relatively short and thus, a relatively small drop in temperature occurs in the heated air as it passes through the parallel streams of grain flowing downwardly in passages 64, 66. There will be some cooling and moisture accumulaton in the drying air as it passes vertically outwardly through the parallel streams of grain 68, 69; however, it will be observed that the grain traveling along the path 68, 69 adjacent side wall 16 will travel a longer path than the grain traveling closer to duct 60. Thus, the portion of the grain subjected to relatively high temperature, dryer air will pass through upper enclosure 12 in a shorter period of time than the portions of grain subjected to the relatively cooler and wetter air and will be subjected thereto for a longer period of time thereby tending to equalize the overall drying effect on all of the grain passing through the apparatus. As the grain reaches the lower extremities of upper drying enclosure 12 and enters discharge opening 74, the two streams of grain following paths 68, 69 are maintained in separate, segregated paths and mixing or co-mingling is prevented by divider plate 136.

As the grain progresses downwardly through discharge opening 74 in upper enclosure 12 and enters inlet opening 83 in lower enclosure 14, the two separate, parallel streams of grain are maintained in passages 86, 88 by duct 84, as shown by arrows 92, 93. Simultaneously, cool air is forced into duct 84 by blower 144 and is forced outwardly through passages 86, 88 and through the parallel streams of grain flowing downwardly therein.

It will now be observed that the heavier, wetter grain adjacent upper side wall sections 80' of lower enclosure 14 precipitates or gravitates downwardly through the dryer grain to the upper side wall sections 84' of duct 84, as shown by dashed lines 87, where it is impacted by cooler, less moisture-laden air. As air flows outwardly through the columns of grain in upper passage sections 86', 88', it is warmed by the hot grain therein and picks up moisture. The downward precipitation or gravitation of the heavier, wetter grain through the dryer grain, described above, mixes the grain generally to provide for more uniform drying.

It will further be seen that the outward flow of air 142' through the upper passage sections 86', 88' is slower by reason of the wider upper passage sections and the thicker, wetter masses of grain respectively therein, than is the outward flow of air 142'' through the lower passage sections 86'', 88''. Subjecting the hot, wet grain in the upper passage sections 86', 88' to the slower air flow results in less severe cooling and the avoidance of stress cracks. As the grain cools in its downward transit to and through lower passage sections 86'', 88'', it can be subjected to higher, cooler air flow since the cooler grain is less susceptible to stress-cracking.

The two, parallel, separate streams of dried grain, 92, 93 are separately discharged through discharge openings 104, 106 to unloading augers 112 under the control of metering rolls 126.

While there have been described above the principles of this invention in connection with specific apparatus, it is to be clearly understood that this description is made only by way of example and not as a limitation to the scope of the invention.

What is claimed is:

1. In continuous flow grain drying apparatus comprising an upper, foraminous drying enclosure having a top end and an open bottom end, means communicating with said top end for introducing grain to be dried to said upper enclosure for downward gravity flow therethrough, first, enclosed, foraminous duct means in said upper enclosure for defining therewith a first pair of passages therein thereby dividing said downward flow into two separate, parallel streams, means communicating with said first duct means for causing an outward flow of heated air simultaneously through said first passages, a lower foraminous cooling enclosure having an open top end connected to said bottom end of said upper enclosure and having a bottom end, second, enclosed, foraminous duct means in said lower enclosure for defining therewith a second pair of passages therein, first divider means connecting said first and second duct means and extending through said open ends of said enclosures for coupling respective ones of said first and second passages whereby said two streams respectively continue separate, downward, parallel flow through said second passages, means communicating with said second duct means for causing an outward flow of cooling air simultaneously through said second passages, said cooling air flow being discharged to the atmosphere, said heating and cooling air flows being in parallel, first and second discharge openings in the side wall of said lower enclosure respectively communicating with said second passages for separately discharging said streams therefrom, and second divider means extending downwardly from said second duct means between said first and second openings for completing separation of said second passages whereby said two streams are maintained separate without co-mingling throughout their downward flow through said apparatus, said lower enclosure and second duct means being respectively formed to divide each of said second passages into upper and lower sections; the improvement wherein said upper passage sections are respectively wider than said lower passage sections whereby the grain in said upper passage sections is cooled more slowly than the grain in said lower passage sections thereby temper-cooling said grain.

2. The apparatus of claim 1 wherein said lower enclosure has a pair of upper, downwardly and outwardly inclined wall sections and a pair of lower, downwardly and inwardly inclined wall sections, said second duct means having a pair of upper, downwardly and outwardly inclined wall sections and a pair of lower, downwardly and inwardly inclined wall sections, said pairs of upper and lower wall sections of said lower enclosure and second duct means being respectively spaced thereby respectively forming said second pair of passages with said upper sections joined to said lower sections.

3. The apparatus of claim 2 wherein said pairs of lower wall sections of said lower enclosure and second duct means are respectively equally spaced whereby said lower passage sections are respectively of equal width throughout their lengths, said pairs of upper wall sections of said lower enclosure and second duct means respectively converging downwardly from their upper to their lower ends whereby said upper passage sections are respectively wider at their upper ends than at their lower ends.

4. The apparatus of claim 3 wherein each of said wall sections is substantially planar.

5. The apparatus of claim 4 wherein said lower enclosure and second duct means are respectively generally quadralateral in cross-section.

6. The apparatus of claim 5 wherein said second duct means is substantially square in cross-section, said first and second divider means being respectively joined to opposite apices of said second duct means.

* * * * *